US011540607B1

(12) United States Patent
Berger et al.

(10) Patent No.: US 11,540,607 B1
(45) Date of Patent: Jan. 3, 2023

(54) BAG ACCESSORIZING SYSTEM

(71) Applicants: Dixie Sandra Berger, Saratoga, WY (US); Kirby Alan Berger, Saratoga, WY (US)

(72) Inventors: Dixie Sandra Berger, Saratoga, WY (US); Kirby Alan Berger, Saratoga, WY (US)

( * ) Notice: Subject to any disclaimer, the term of this patent is extended or adjusted under 35 U.S.C. 154(b) by 312 days.

(21) Appl. No.: 16/779,985

(22) Filed: Feb. 3, 2020

Related U.S. Application Data

(62) Division of application No. 15/454,495, filed on Mar. 9, 2017, now Pat. No. 10,582,749.

(60) Provisional application No. 62/305,616, filed on Mar. 9, 2016.

(51) Int. Cl.
*A45C 13/30* (2006.01)
*A45C 3/06* (2006.01)

(52) U.S. Cl.
CPC ..... *A45C 13/30* (2013.01); *A45C 3/06* (2013.01); *A45C 2013/306* (2013.01)

(58) Field of Classification Search
CPC ..... A45C 13/30; A45C 3/06; A45C 2013/306
See application file for complete search history.

(56) References Cited

U.S. PATENT DOCUMENTS

| | | | | |
|---|---|---|---|---|
| 259,239 | A | 6/1882 | Stowell | |
| 327,407 | A * | 9/1885 | Oswald | A43C 11/22 24/575.1 |
| 455,393 | A * | 7/1891 | Ford | B65D 88/1618 383/68 |
| 1,658,997 | A * | 2/1928 | Mulford | A45C 3/00 190/902 |
| 2,319,729 | A | 5/1943 | Ford | |
| 2,405,361 | A | 8/1946 | Edward et al. | |
| 2,712,337 | A | 7/1955 | Tremblay | |
| 5,983,403 | A * | 11/1999 | Neeley | A41F 9/002 2/338 |
| 7,762,294 | B2 | 7/2010 | Wang | |
| D650,168 | S | 12/2011 | Littleton | |
| D802,917 | S | 11/2017 | Fusi | |

* cited by examiner

*Primary Examiner* — Tri M Mai
(74) *Attorney, Agent, or Firm* — Leber IP Law; Celia H. Leber

(57) ABSTRACT

A bag accessorizing system that enables a user to attach and remove personal items to a bag. The items thus attached can quickly be located during transport and removed for use. The accessories are attached by an attachment device that uses a slot and locking strap along with a ring that is attached to the bag. Some accessories can serve in multiple roles such as a belt acting as a bag strap.

14 Claims, 9 Drawing Sheets

BAG ACCESSORIZING SYSTEM

CROSS-REFERENCE TO RELATED APPLICATIONS

This application is a divisional application of U.S. patent application Ser. No. 15/454,495, filed Mar. 9, 2017, which claims priority from U.S. patent application Ser. No. 62/1305,616, filed Mar. 9, 2016, the entire disclosures of which are incorporated herein by reference.

BACKGROUND

Field of the Invention

The present invention relates generally to bag systems, and more specifically, to a bag accessorizing system for attaching personal items to a bag.

Description of Related Art

Bag systems are well known in the art and are effective means to carry items. For example, FIGS. 1A and 1B respectively depict a side view and cross-sectional side view of a conventional bag system 101 having a bag 103 and personal items 105. During use, the personal items 105 are placed in the bag 103 and transported, as depicted by FIG. 1B.

One of the problems commonly associated with system 101 is its limited use. For example, personal items 105 stored together within the bag 103 tend to shift during transport such that locating a specific personal item 105 that is stored within the bag 103 can be tedious to the user.

Accordingly, although great strides have been made in the area of bag systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
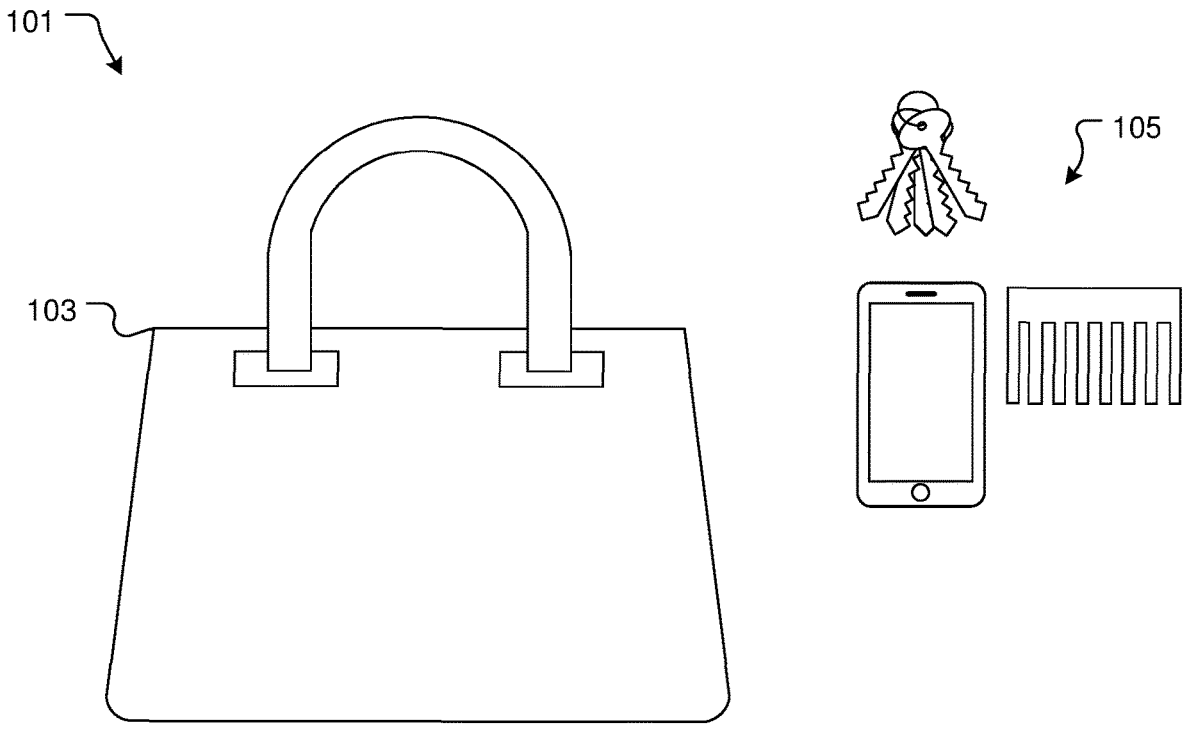
FIG. 1A (Prior Art)
FIGS. 1A and 1B respectively show a side view and a cross-sectional side view of a common bag system.
Figure 1B:
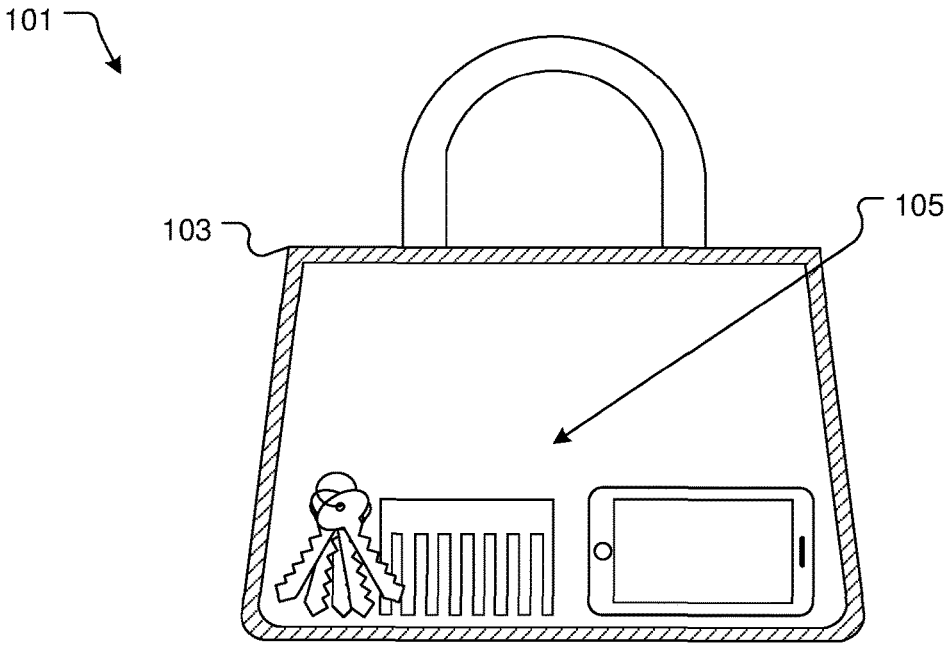
FIG. 1B (Prior Art)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional bag systems. Specifically, the system of the present application enables the bag to be accessorized such that a user can easily access individual personal items carried by the bag. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
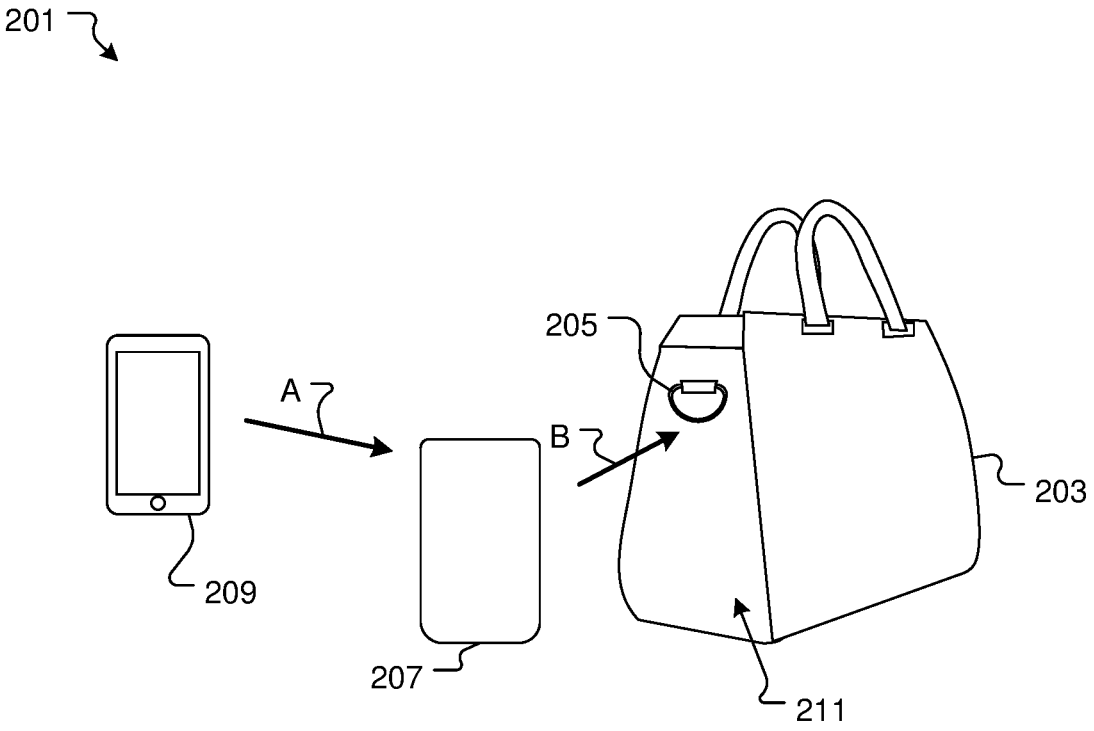
FIGS. 2A and 2B are perspective views of a bag accessorizing system at various stages of use in accordance with a preferred embodiment of the present application.
Figure 2B:
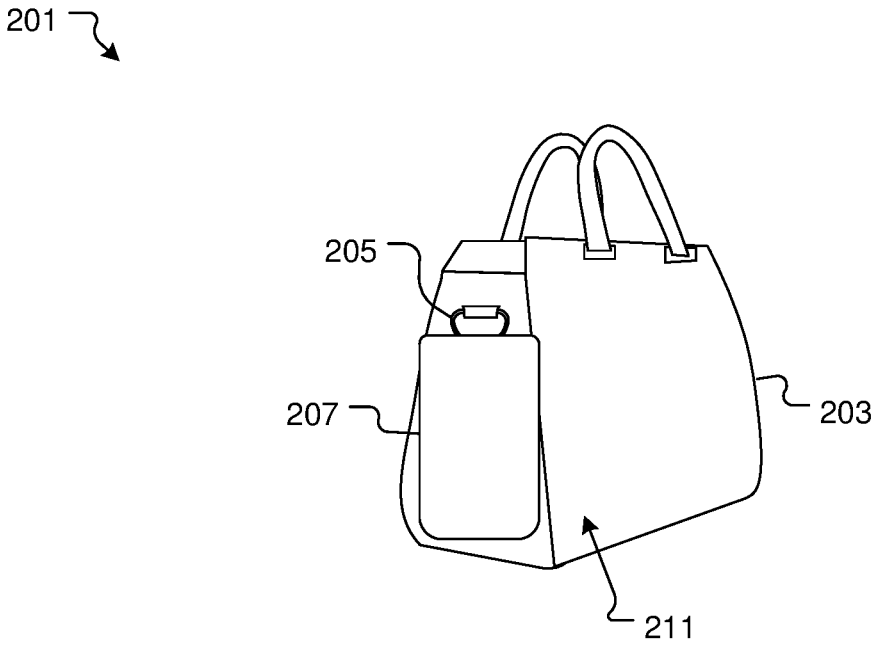

Referring now to the drawings wherein like reference characters identify corresponding or similar elements throughout the several views, FIGS. 2A and 2B depict perspective views of a bag accessorizing system at various stages of use in accordance with a preferred embodiment of the present application. It will be appreciated that system 201 overcomes one of more of the above-listed problems commonly associated with conventional bag systems.

In the contemplated embodiment, system 201 includes a bag 203 having a ring 205 rigidly attached to the outer surface 211 that is configured to attach an accessory 209 to the bag 203 via an accessory attachment device 207 is used to attach the accessory 209 to the bag 203 as depicted by motion A and B.

Figure 3A:
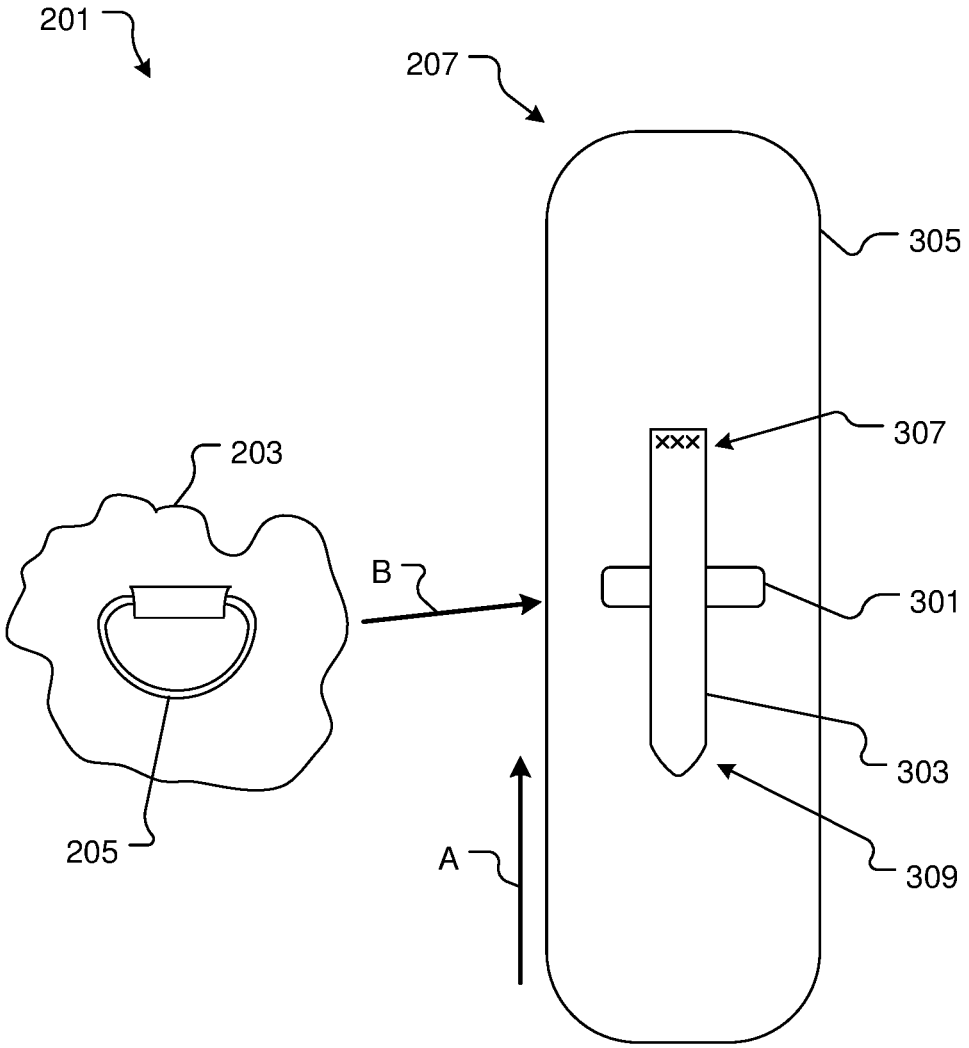
FIGS. 3A, 3B and 3C are front views of the latch of FIGS. 2A and 2B at various stages of assembly.
Figure 3B:
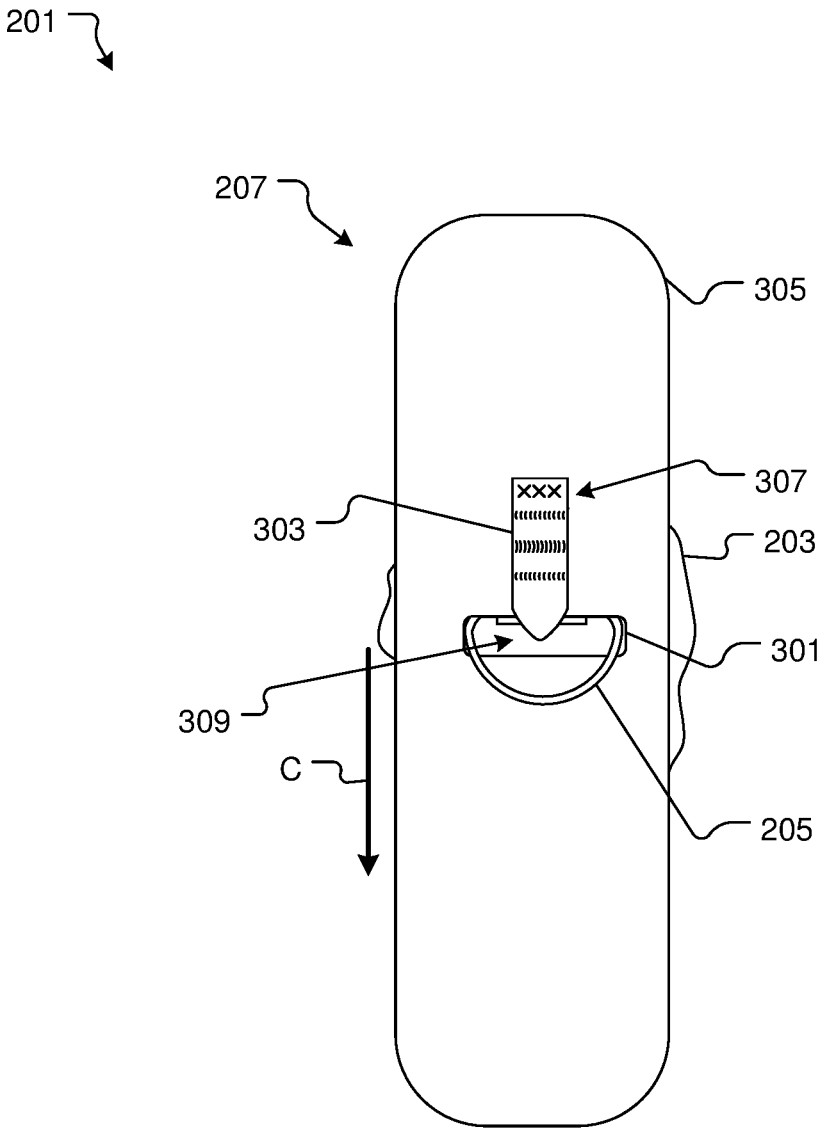
Figure 3C:
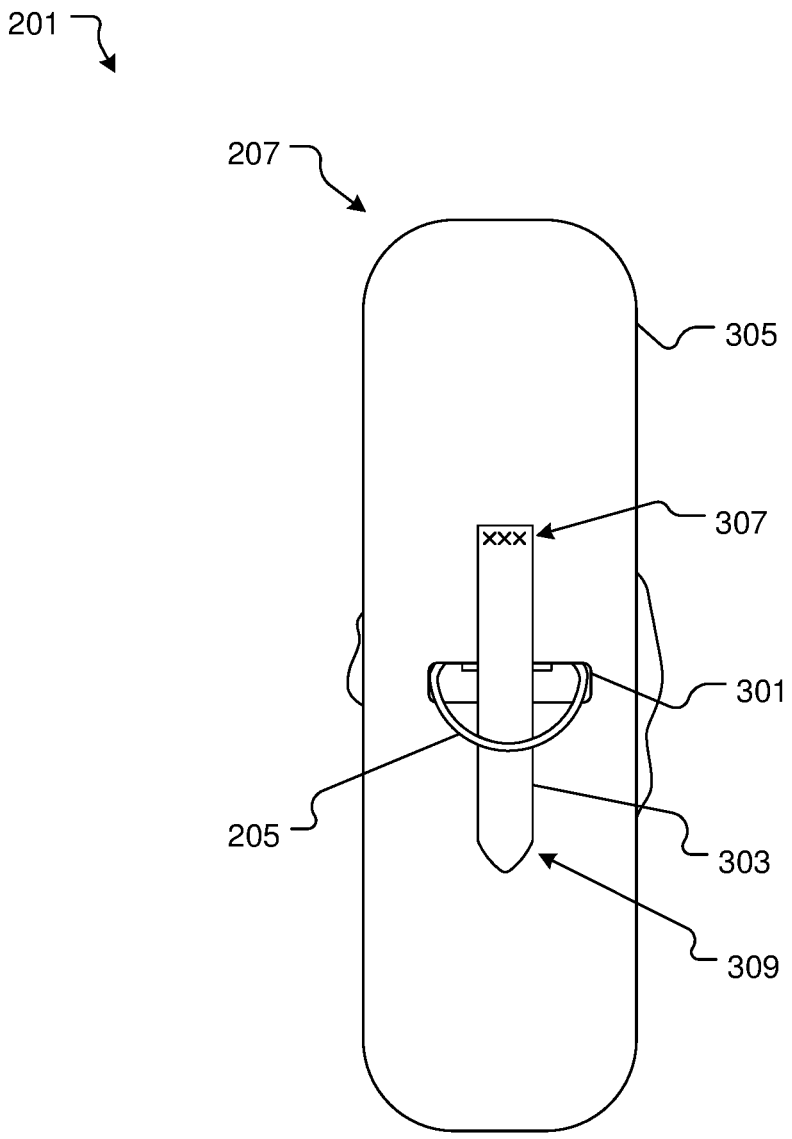

Referring to FIGS. 3A, 3B and 3C the attachment device is depicted, wherein the attachment device 207 includes body 305 of configured to hold the accessory 209. The body 305 being penetrated by a slot 301 of a size and shape to allow the ring 205 to pass through. The body 305 having a locking strap 303 rigidly attached at one end 307 and the loose end 309 is free to move and extends over the slot 301.

In use the locking strap 303 is moved away from the slot 301 as depicted by motion A to enable insertion of the ring 205 that is attached to bag 203. The ring is inserted in the slot 301 of the attachment device 207, as depicted by motion B. The locking strap 303 passes through the ring 205, as depicted by motion C. (Note that the personal item 209 of system 201 is omitted for clarity).

In the current embodiment the attachment device 207 is a cell phone case however a bag strap, a key holder, or any type of accessory is anticipated.

It should be appreciated that one of the unique features believed characteristic of the present application is that attachment device 207 enables a user to personalize and quickly access individual accessories 209 that are carried by the bag 203.

Another unique feature believed characteristic of the present application is the ease of use. For example, a user can quickly secure or remove attachment device 207 and any accompanying accessories 209 from the bag 203 to accommodate circumstances and preference by removing the locking strap 303.

Figure 4:
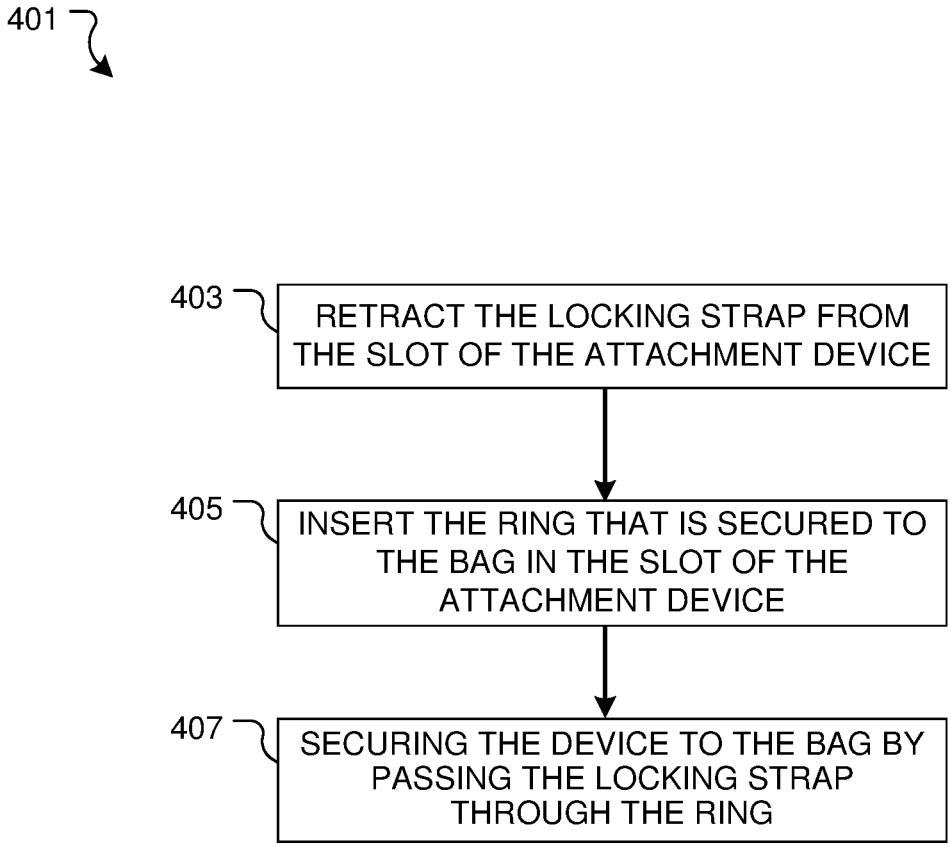
FIG. 4 is a process diagram of the system of FIGS. 2A and 2B.

Referring now to FIG. 4 where the process of attaching an accessory 209 to a bag is depicted. The process 401 including retracting the locking strap from the slot of the attachment device 403, inserting the ring that is secured to the bag through the slot of the attachment device 405 and securing the device to the bag by passing the locking strap through the ring 407.

Figure 5A:
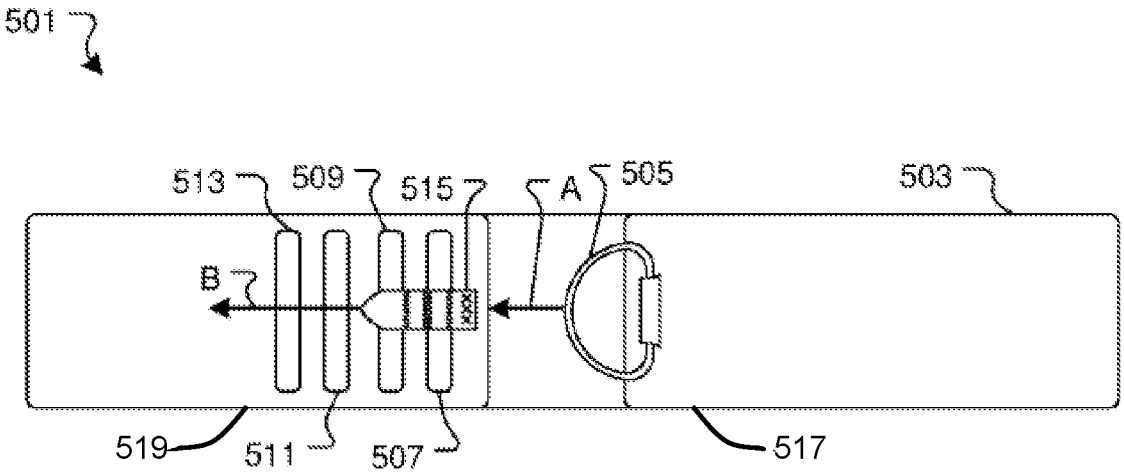
FIGS. 5A and 5B are front views of an alternative embodiment of the system of FIGS. 2A and 2B.
Figure 5B:
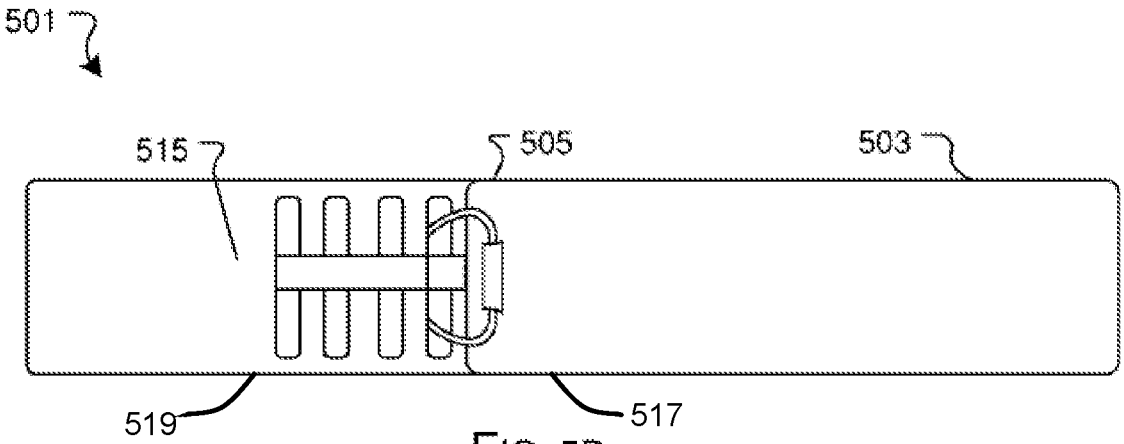

Referring now to FIGS. 5A and 5B an alternative embodiment of the bag accessorizing system 201 is depicted. The embodiment 501 being in the form a belt and includes a band 503 that has a first end 517 that removably attaches to a second end 519.

The first end 517 having a ring 505 rigidly attached. The second end 519 having a plurality of slots 507, 509, 511, 513 that pass through the band 503. The second end 519 also having a locking strap 515 rigidly attached in proximity to the slots 507, 509, 511, 513. In use the band 503 functions as a belt and is secured by passing the ring 505 through the one of the slots 507, 509, 511, 513 as depicted by motion A and securing the ring 505 with the locking strap 515 as depicted by motion B. It will be appreciated that the embodiment 501 will also function as a bag strap by attaching the first end 517 to a bag and the second end 519 at another point of the bag in the manner previously disclosed in FIGS. 2A and 2B.

It will be appreciated that the user adjusts the length of the bag strap, belt or any similar like accessory by inserting the ring 205, 505 into the desired slot 301, 507, 509, 511, 513 at the selected attaching location. A plurality of slots 301, 507, 509, 511, 513 are located in proximity to each other as depicted in FIGS. 5A and 5B to enable this feature.

Figure 6A:
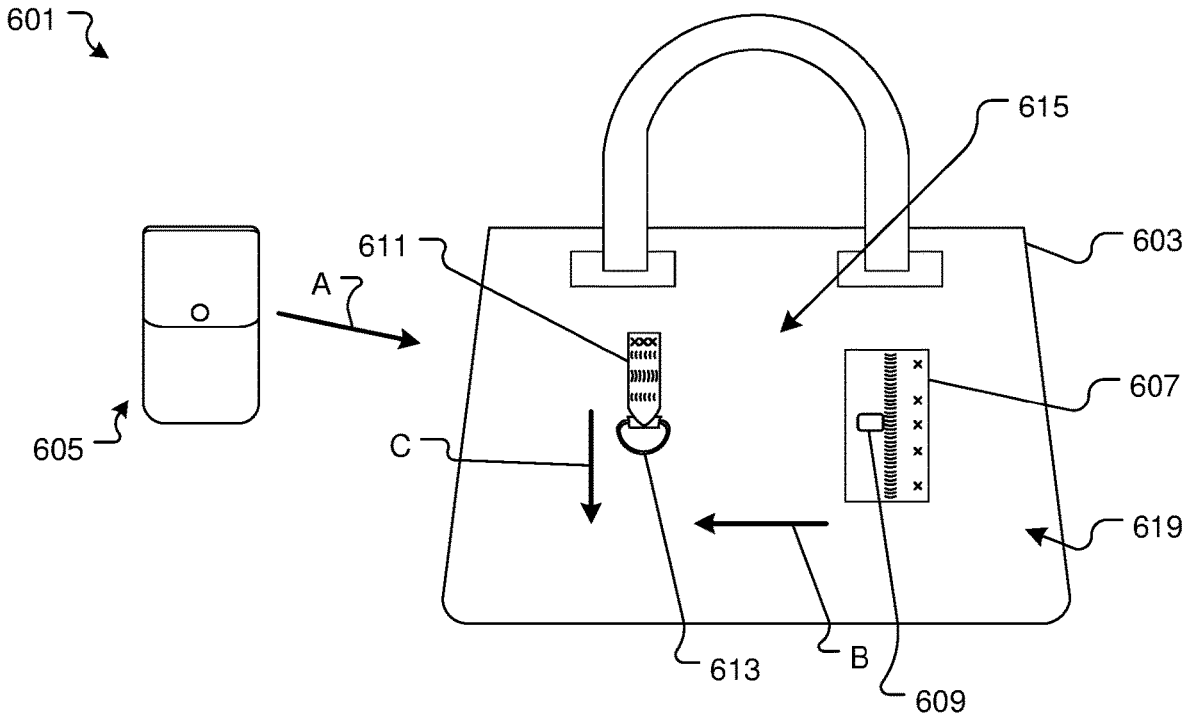
FIGS. 6A and 6B are front views of an alternative embodiment of the system of FIGS. 2A and 2B.
Figure 6B:
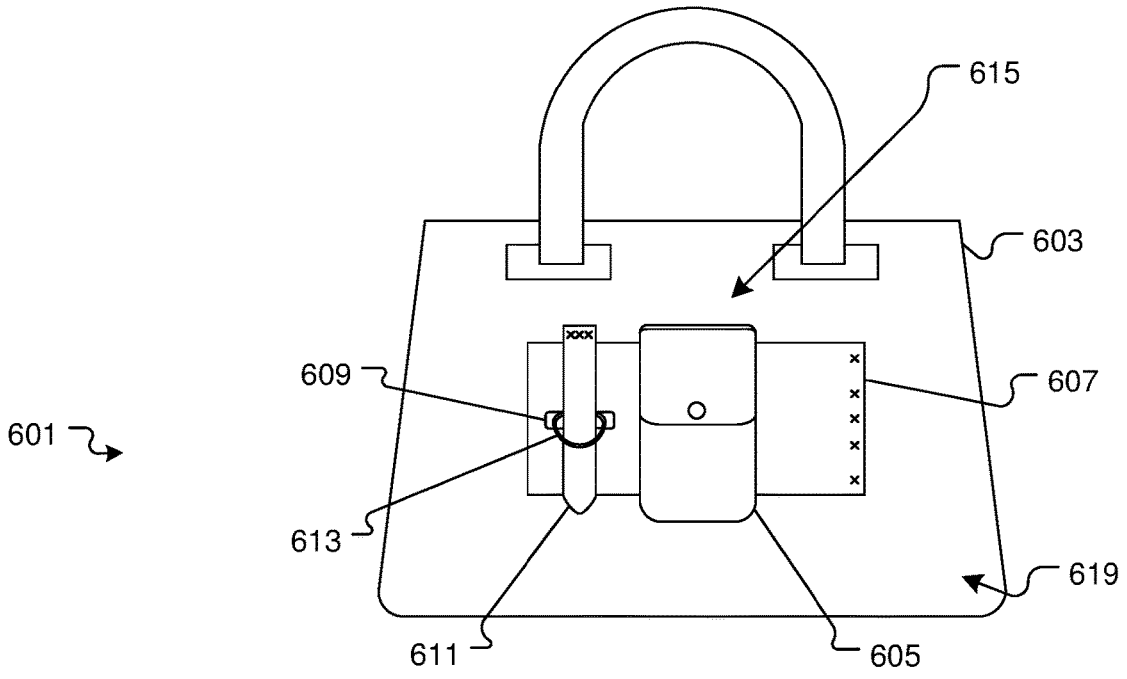

Referring now to FIGS. 6A, and 6B an alternative embodiment of attaching an accessory 209 to a bag 203 is depicted at various stages of use. The embodiment 601 includes a bag 603 that attaches to a personal accessory 605 via an attachment device 615.

The attachment device 615 having a support strap rigidly attached to outer surface 617 of the bag 603. The device 615 also having a locking strap 611 rigidly attached to the outer surface 617 of the bag 603 in proximity of a ring 613.

The support strap 607 having a slot 609 that passes there through configured to allow the ring 613 to enter and extend through the slot 609. In this embodiment 601 the support strap 607 attaches to the accessory 605 and is then secured to the bag 603 via the slot 609, locking strap 611, and ring 613 as depicted by motions A and B.

Figure 7:
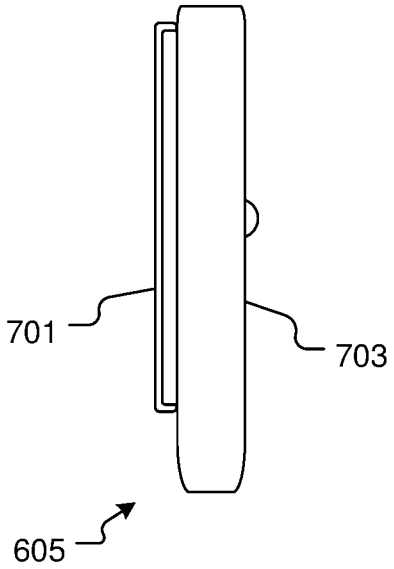
FIG. 7 is a side view of the accessory of FIGS. 6A and 6B.

FIG. 7 depicts a side view of the accessory 605. The accessory 605 having a loop 701 or the like rigidly attached to the accessory body 703. The loop 701 receives the support strap 607 of FIG. 6A and 6B connecting the accessory 605 to the bag 603.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A belt comprising:

a band having a first end and a second end, a first surface and a second surface, and a plurality of slots extending through the band between the first end and the second end from the first surface to the second surface;

a belt ring fixedly attached to the first surface of the band adjacent the first end such that the belt ring lies generally flat against the first surface, the belt ring being configured for insertion through the slots by sliding a distal end of the belt ring into one of the slots in a lateral direction along the first surface; and a locking strap fixedly attached to the band in proximity to the slots, the locking strap being configured to secure the belt ring in place when the belt ring is inserted through one of the slots.

2. The belt of claim 1 wherein the slots are generally rectangular.

3. The belt of claim 1 wherein the belt ring is a D-ring.

4. The belt of claim 1 wherein the band includes at least four slots.

5. The belt of claim 1 wherein the slots are positioned so that the belt will be sufficiently adjustable for use both as a belt and as a strap for a bag.

6. The belt of claim 1 wherein the slots are elongated and have longitudinal axes that are generally parallel to each other.

7. The belt of claim 6 wherein the locking strap has a longitudinal axis that extends generally perpendicular to the longitudinal axes of the slots.

8. The belt of claim 6 wherein the belt ring has a curved portion that is inserted through the slots and a straight portion that is secured to the band, the straight portion extending generally parallel to the longitudinal axes of the slots.

9. The belt of claim 1 wherein the belt ring has a diameter that is substantially equal to a length of the slots.

10. The belt of claim 9 wherein the locking strap has a width that is less than the diameter of the belt ring.

11. A system comprising:

a belt including a band having a first end and a second end, a first surface and a second surface, and a plurality of slots extending through the band between the first end and the second end from the first surface to the second surface;

a belt ring fixedly attached to the first surface of the band adjacent the first end such that the belt ring lies generally flat against the first surface, the belt ring being configured for insertion through the slots by sliding a distal end of the belt ring into one of the slots in a lateral direction along the first surface; and a locking strap fixedly attached to the band in proximity to the slots, the locking strap being configured to secure the belt ring in place when the belt ring is inserted through one of the slots; and a bag including a bag body, a bag ring fixedly attached to the body, the bag ring being configured for insertion through the slots of the band, an opening configured to receive the belt ring, and a locking strap fixedly attached to the body in proximity to the bag ring, the locking strap being configured to secure the bag ring in place when the bag ring is inserted through one of the slots in the band.

12. A method of accessorizing a bag, the method comprising;

providing a system including (a) a belt including a band having a first end and a second end, a first surface and a second surface, and a plurality of slots extending through the band between the first end and the second end from the first surface to the second surface;

a belt ring fixedly attached to the first surface of the band adjacent the first end such that the belt ring lies generally flat against the first surface, the belt ring being configured for insertion through the slots by sliding a distal end of the belt ring into one of the slots in a lateral direction along the first surface; and a belt locking strap fixedly attached to the band in proximity to the slots, the locking strap being configured to secure the belt ring in place when the belt ring is inserted through one of the slots; and (b) a bag including a bag body, a bag ring fixedly attached to the body, the bag ring being configured for insertion through the slots of the band, an opening configured to receive the belt ring, and a bag locking strap fixedly attached to the body in proximity to the bag ring, the locking strap being configured to secure the belt ring in place when the belt ring is inserted through one of the slots in the band; and using the belt as a strap for the bag by inserting the belt ring through the opening in the bag body and securing the belt ring in place with the bag locking strap, and inserting the bag ring through a slot in the band and securing it in place with the belt locking strap.

13. The method of claim 12, further comprising removing the belt from the bag and securing the belt around a user's waist by inserting the belt ring through one of the slots and securing the belt ring in place using the belt locking strap.

14. The method of claim 13, further comprising adjusting the size of the belt by selecting an appropriate one of the slots for insertion of the belt ring.

* * * * *